US007146021B2

(12) United States Patent
Danovi

(10) Patent No.: US 7,146,021 B2
(45) Date of Patent: Dec. 5, 2006

(54) WHIZZER CONE FOR LOUDSPEAKER FOR PRODUCING UNIFORM FREQUENCY RESPONSE

(75) Inventor: Benny L. Danovi, Chula Vista, CA (US)

(73) Assignee: Pioneer Speakers, Inc., San Diego, CA (US)

( * ) Notice: Subject to any disclaimer, the term of this patent is extended or adjusted under 35 U.S.C. 154(b) by 0 days.

(21) Appl. No.: 10/746,233

(22) Filed: Dec. 29, 2003

(65) Prior Publication Data

US 2004/0197008 A1 Oct. 7, 2004

Related U.S. Application Data

(63) Continuation of application No. 09/774,617, filed on Feb. 1, 2001, now abandoned.

(51) Int. Cl.
*H04R 7/12* (2006.01)

(52) U.S. Cl. ..... 381/432; 381/423

(58) Field of Classification Search ..... 381/396, 381/423, 424, 432; 181/153, 154, 157, 164, 181/165, 173, 423, 192
See application file for complete search history.

(56) References Cited

U.S. PATENT DOCUMENTS 1,757,107 A * 5/1930 Baltzley ..... 181/164
3,961,378 A 6/1976 White
4,881,617 A * 11/1989 Faraone ..... 181/164
6,026,928 A 2/2000 Maharaj
6,026,929 A * 2/2000 Faraone ..... 181/173
6,334,505 B1 * 1/2002 Li ..... 181/192

FOREIGN PATENT DOCUMENTS

JP 55052697 A * 4/1980

* cited by examiner

*Primary Examiner*—Sinh Tran
*Assistant Examiner*—Brian Ensey
(74) *Attorney, Agent, or Firm*—Steve A. Wong

(57) ABSTRACT

A speaker cone is provided that contains a base portion, and the base portion has a front end and a rear end. The front end contains a plurality of discontinuities such that a first distance from a reference point on a longitudinal axis of the base portion to a first point on the front end is different than a second distance from the reference point to a second point on the front end. By creating the plurality of discontinuities in the front end of the base portion, the distortion or reduction in the amplitude of a flexural wave generated by the speaker cone is dramatically reduced.

22 Claims, 9 Drawing Sheets

WHIZZER CONE FOR LOUDSPEAKER FOR PRODUCING UNIFORM FREQUENCY RESPONSE

This is a continuation of application Ser. No. 09/774,617 filed Feb. 1, 2001 now abandoned; the disclosure of which is incorporated herein by reference.

FIELD OF THE INVENTION

The present invention relates to a whizzer cone for loudspeaker. More particularly, the present invention relates to a whizzer cone that enhances the high frequency response of the loudspeaker by radiating effectively at mid to high audio frequencies.

BACKGROUND OF THE INVENTION

In order to accurately reproduce sound based on input audio signals, a loudspeaker must be capable of precisely generating sound for a wide range of frequencies of the input audio signals. For example, input audio signals corresponding to musical songs have a wide range of frequencies relating to the various instruments creating the music and relating to the human vocal sounds corresponding to the lyrics that accompany the music. Thus, to accurately reproduce the audio signals, the loudspeaker generally has at least a main speaker cone for reproducing the low and mid-range frequencies of the audio signals. Furthermore, since the main speaker cone cannot effectively reproduce high frequency sounds, a whizzer cone has been developed for reproducing the high range frequencies of the audio signals. Typically, in the loudspeaker, the transition between the main speaker cone operation and the whizzer cone operation occurs when the frequencies of the audio signals reach between 4000 Hz and 8000 Hz.

An example of a whizzer cone 1 that reproduces high frequency sounds is illustrated in FIGS. 1*a* and 1*b*. FIG. 1*a* is a side view of the whizzer cone 1, and FIG. 1*b* is a top view of the whizzer cone 1. As shown in the figures, the whizzer cone 1 comprises a base portion 2 having a front end 3 and a rear end 4. The front end 3 generally has a circular shape and lies within a single plane. Similarly, the rear end 4 generally has a circular shape, which is concentric with the circular shape of the front end 3, but the diameter of the rear end 4 is smaller than the diameter of the front end 3. Also, the base portion generally has a frustro-conical shape having a circular cross-section, and the diameter of the cross-section of the base portion 2 gradually increases from the rear end 4 to the front end 3.

Also, as best shown in FIG. 1*b*, a rear wall 5 is formed at the rear end 4 of the base portion 2, and the circular front end 3 defines an opening to the base portion 2. Sound is generated from the vibration of the whizzer cone 1, and the vibration generally travels from the rear end 4 and/or rear wall 5 and is radiated from the whizzer cone 1. On the other hand, if the whizzer cone 1 is attached to a loudspeaker at an attachment point other than the rear end 4 and/or rear wall 5, the vibration generally travels from the attachment point and is radiated from the whizzer cone 1.

FIG. 2 illustrates an example of cross-sectional view of a loudspeaker 10 that comprises the whizzer cone 1 shown in FIGS. 1*a* and 1*b*. As shown in the figure, the loudspeaker 10 comprises the whizzer cone 1, a main speaker cone 12 having a flexible rim portion 14, a chassis 16, and a voice coil former 18. The coil former 18 is formed in a rear portion 16*a* of the chassis 16, and the whizzer cone 1 is fitted into a front opening 18*a* of the coil former 18. In addition, a rear end 12*a* of the main speaker cone 12 is fitted around the front opening 18*a* of the coil former 18, and the rim portion 14 of the speaker cone 12 is coupled to a front portion 16*b* of the chassis 16. Although the whizzer cone 1 is incorporated into the loudspeaker 10 by fitting it within the front opening 18*a* of the coil former 18, one skilled in the art, upon reading the present application, would clearly know many different manners in which the whizzer cone 1 could be incorporated into the loudspeaker 10. For example, the whizzer cone 1 could be attached to the main speaker cone 12 instead of the voice coil former 18.

Based on the configuration above, when audio signals having low to mid-range frequencies are input to the loudspeaker 10, the main speaker cone 12 responds to such signals and vibrates to reproduce corresponding sounds. On the other hand, when audio signals having high range frequencies are input to the loudspeaker 10, the whizzer cone 1 responds to such signals and vibrates to reproduce corresponding sounds. Furthermore, as noted above, the main speaker cone 12 ceases reproducing sounds and the whizzer cone 1 begins to reproduce sounds when the frequency of the audio signals reach a frequency between 4000 Hz and 8000 Hz. Accordingly, by incorporating the whizzer cone 1 into the loudspeaker 10, the loudspeaker is capable of reproducing sounds corresponding to a wide range of audio signal frequencies.

However, the loudspeaker 10 described above suffers from several disadvantages. For example, in the loudspeaker 10, the outer edge of the main speaker cone 12 is damped because it is physically coupled to the front portion 16*b* of the chassis 16 via the rim portion 14. On the other hand, the front end 3 of the whizzer cone 1 is not connected to any portions of the loudspeaker 10. As a result, the geometric modes at occurring near the front end 3 of the whizzer cone 1 are undamped and create irregularities in the frequency response of the whizzer cone 1. One of the most noticeable irregularities is the occurrence of sharp dips in the frequency response of the whizzer cone 1 at certain frequencies ("dip frequencies") or certain ranges of frequencies ("dip frequency ranges"). In other words, when an audio signal is input to the loudspeaker 10 which has one of the certain frequencies or has a frequency that falls within one of the certain ranges of frequencies, the whizzer cone 1 cannot accurately reproduce a sound corresponding to the audio signal. Typically, the damaging dip frequencies of the whizzer cone 1 occur between 10,000 Hz and 20,000 Hz.

A graphical example of the dip 30 in the responsiveness of the whizzer cone 1 is shown in FIG. 3. As clearly shown in the figure, as the dip 30 becomes deeper and/or wider, the performance quality of the loudspeaker 10 decreases.

In addition to sharp dips, irregularities in the frequency response of the whizzer cone 1 may take the form of sharp peaks in the frequency response at certain frequencies ("peak frequencies") or certain ranges of frequencies ("peak frequency ranges"). As the name implies, a peak is a sharp rise in the frequency response of the whizzer cone 1. Moreover, as a peak becomes taller and/or wider, the performance quality of the loudspeaker 10 decreases.

Some techniques have been developed to attempt overcome the above problem. For example, in one technique, the dips and peaks in the responsiveness of the whizzer cone 1 have been reduced by optimizing the dimensions of the whizzer cone 1 and the properties of the materials forming the whizzer cone 1. However, while such technique has somewhat reduced the frequency response irregularities of the whizzer cone 1, such irregularities are still very prominent, and the performance quality of the loudspeaker is still relatively low.

SUMMARY OF THE INVENTION

An object of the present invention is to overcome the above and other problems associated with speaker cones.

Another object of the present invention is to improve the frequency response of speaker cones.

In order to achieve the above and other objects, a speaker cone is provided. The speaker cone comprises: a base portion having a front end and a rear end, wherein the front end contains at least one discontinuity such that a first distance from a reference point on a longitudinal axis of the base portion to a first point on the front end is different than a second distance from the reference point to a second point on the front end.

In order to further achieve the above and other objects, a speaker cone is provided. The speaker cone comprises: a base portion having a front end and a rear end, wherein the front end contains a plurality of discontinuities that form a cyclical wave in the front end of the base portion.

BRIEF DESCRIPTION OF THE DRAWINGS

The above and other objectives and advantages of the present invention will become more apparent by describing in detail preferred embodiments thereof with reference to the attached drawings in which.

DESCRIPTION OF THE PREFERRED EMBODIMENT(S) OF THE INVENTION

The following description of the preferred embodiments discloses specific configurations and components. However, the preferred embodiments are merely examples of the present invention, and thus, the specific features described below are merely used to more easily describe such embodiments and to provide an overall understanding of the present invention. Accordingly, one skilled in the art will readily recognize that the present invention is not limited to the specific embodiments described below. Furthermore, the descriptions of various configurations and components of the present invention that are known to one skilled in the art are omitted for the sake of clarity and brevity.

Figure 1A:
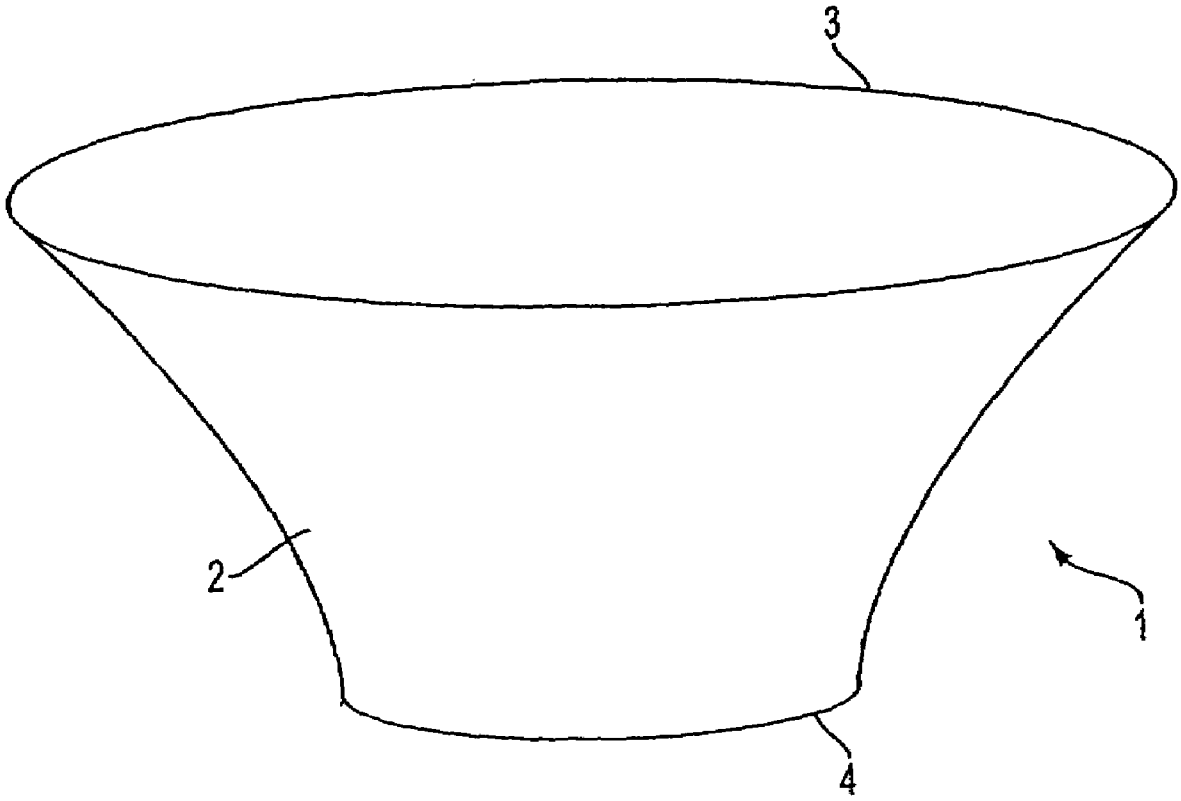
FIG. 1A Prior Art
FIG. 1*a* is a side view of a whizzer cone.
Figure 1B:
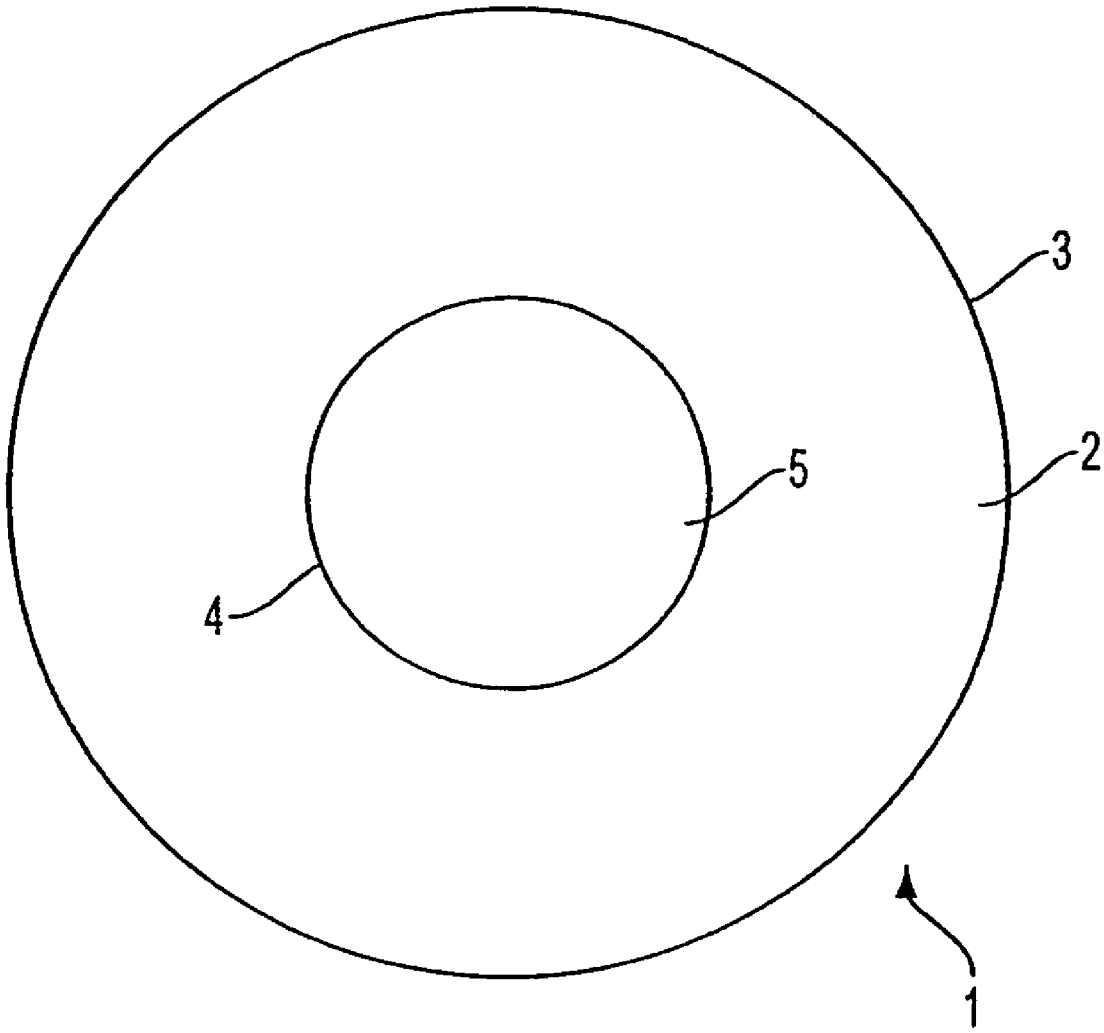
FIG. 1B Prior Art
FIG. 1*b* is a top view of the whizzer cone shown in FIG. 1*a;*
Figure 2:
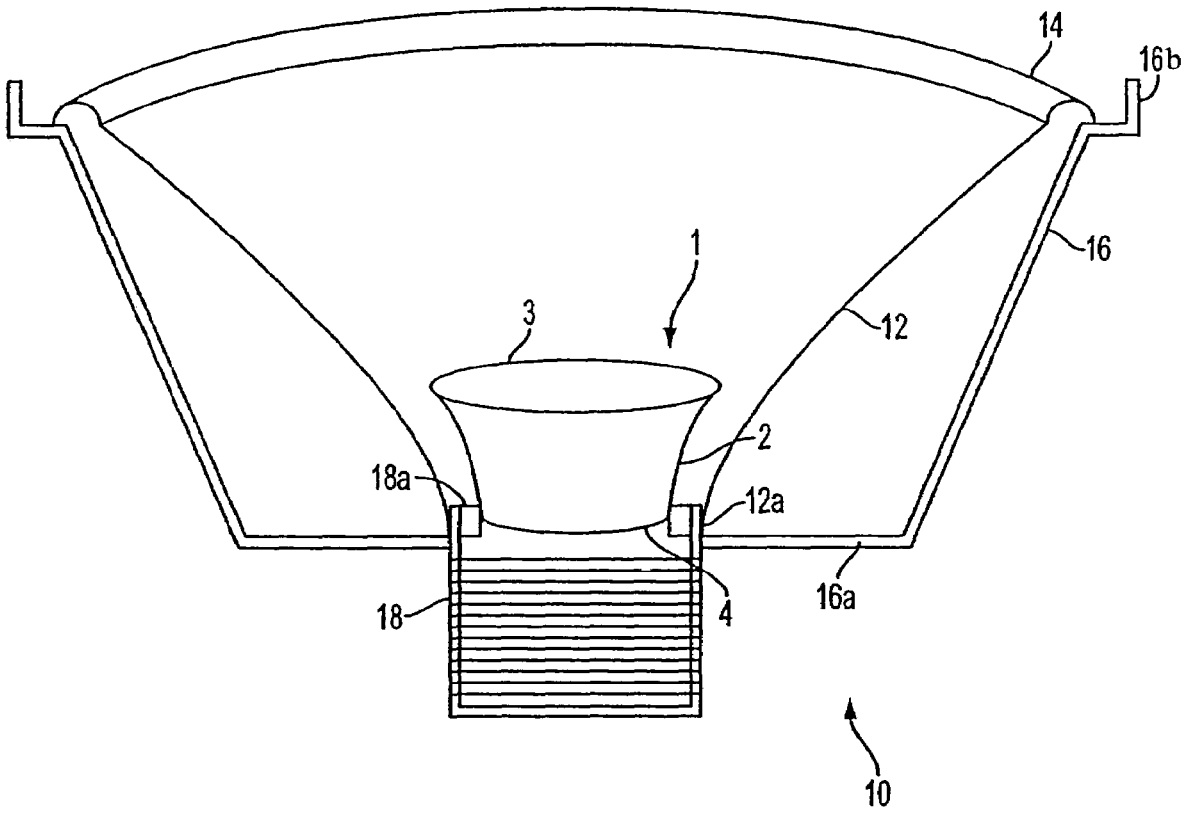
FIG. 2 Prior Art
FIG. 2 is a cross-sectional view of a loudspeaker that contains the whizzer cone shown in FIGS. 1*a* and 1*b;*
Figure 3:
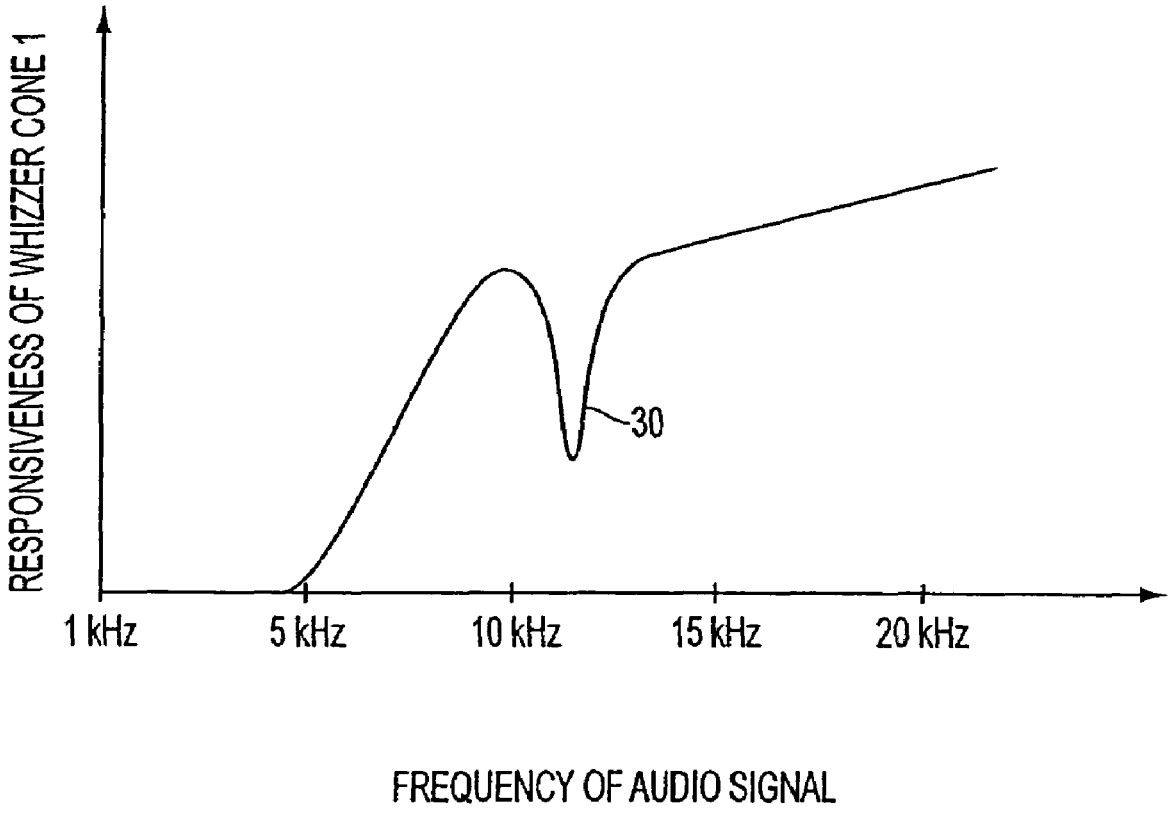
FIG. 3 Prior Art
FIG. 3 is a graphical view of a dip in the responsiveness of the whizzer cone shown in FIGS. 1*a* and 1*b;*

In order to better explain the preferred embodiments of the present invention, various properties and characteristics of the whizzer cone 1 shown in FIGS. 1*a* and 1*b* will first be described. Such properties and characteristics were determined based on various mathematical computations and experiments.

When the whizzer cone 1 is subjected to audio signals having a particular range of frequencies (e.g. 5 kHz to 30 kHz), the vibration of the whizzer cone 1 increased. Thus, at such high frequencies, the whizzer cone 1 radiates sound. There are at least two manners in which the whizzer cone 1 radiates sound. In the first manner, the whizzer cone 1 acts as a horn, and vibrations generated in the rear of the whizzer cone 1 travel along the interior of the base portion 2 and past the front end 3. In the second manner, the sides of the whizzer cone 1 (i.e. the sides of the base portion 2) vibrate and create sound.

When the whizzer cone 1 vibrates, flexural waves and other waves are generated and create vibrational mode resonances, which include flexural mode resonances (e.g. radial and circumferential mode resonances). The vibrational mode resonances have certain resonance frequencies that are based on the dimensions of the whizzer cone 1 and the properties of the material used to make the whizzer cone 1.

When resonance occurs at these modal frequencies, the amplitude of the sound produced by the whizzer cone 1 can be substantially reduced or increased, resulting in a non-uniform frequency response of the whizzer cone 1. Such a non-uniform frequency response contains dips (which cause the substantial amplitude reductions) and peaks (which cause the substantial amplitude increases) and may reduce the frequency bandwidth of the whizzer cone 1. As a result, the frequency response of the whizzer cone 1 is substantially degraded at the particular resonance frequencies. Such resonance frequencies correspond to the dips and peaks in the responsiveness of the whizzer cone 1 described above.

The present invention relates to a whizzer cone that has a configuration that substantially reduces and/or eliminates the effects of the vibrational mode resonances. As a result, the frequency dependent dips or peaks in the responsiveness of the whizzer cone are likewise substantially reduced and/or eliminated.

Figure 4A:
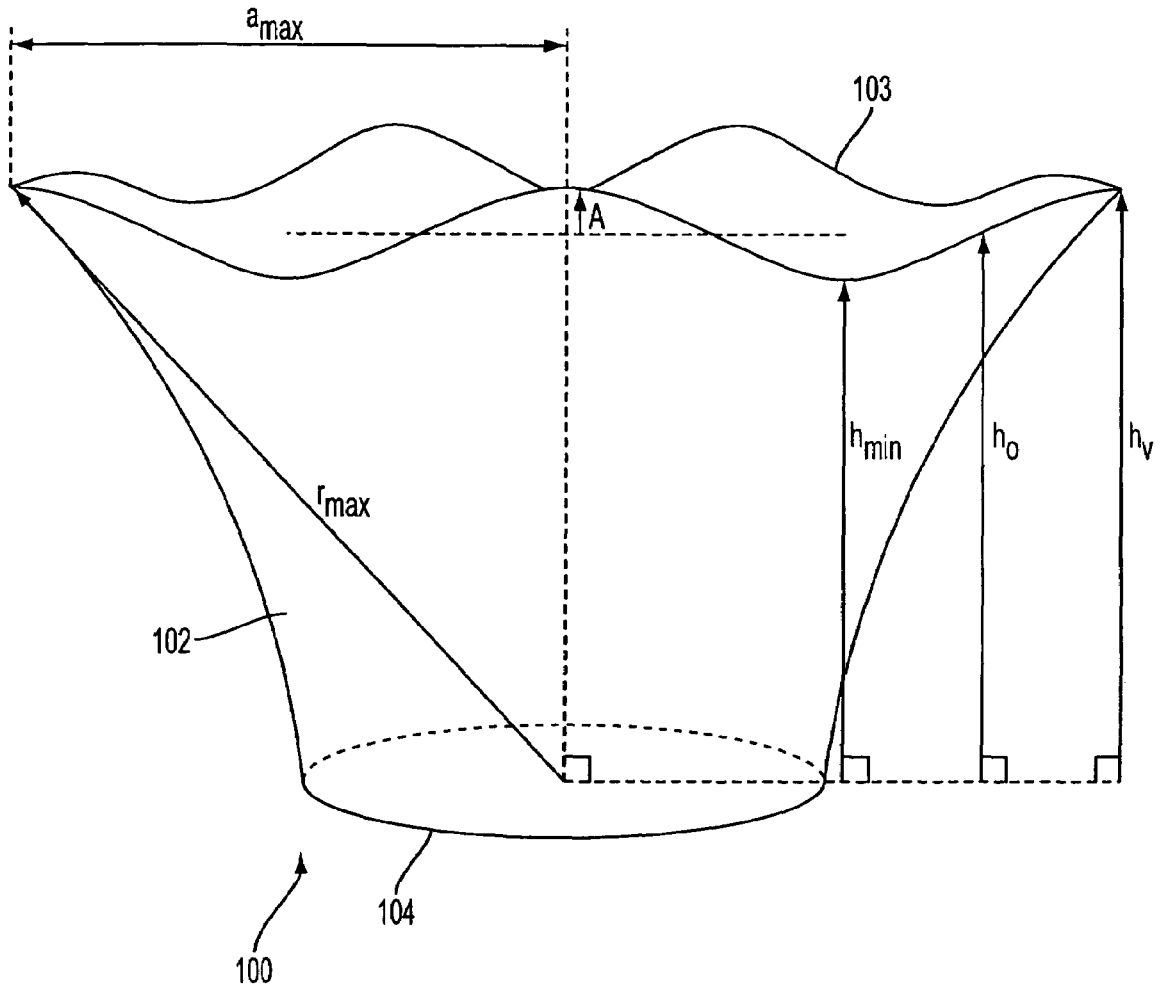
FIG. 4*a* is a side view of a whizzer cone in accordance with an illustrative embodiment of the present invention.
Figure 4B:
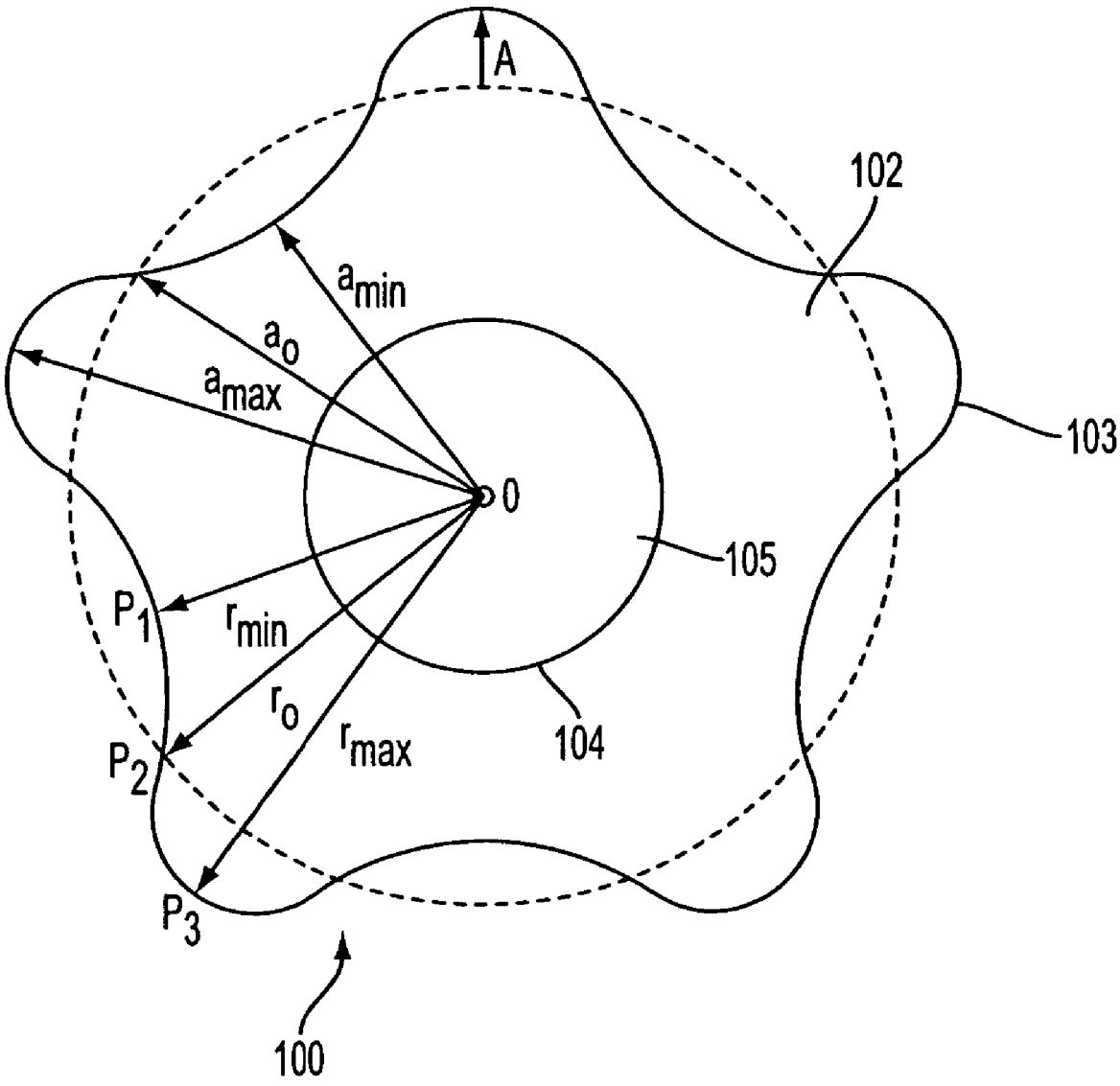
FIG. 4*b* is a top view of the whizzer cone shown in FIG. 4*a;*

An example of a whizzer cone 100 in accordance an illustrative, non-limiting embodiment of the present invention is shown in FIGS. 4*a* and 4*b*. FIG. 4*a* is a side view of the whizzer cone 100, and FIG. 4*b* is a top view of the whizzer cone 100. As shown in the figures, the whizzer cone 100 comprises a base portion 102 having a front end 103 and a rear end 104. The base portion 102 generally has a frustro-conical shape having a circular cross-section, and the radius of the circular cross-section gradually increases from the rear end 104 to the front end 103.

Also, as best shown in FIG. 4*b*, the rear end 104 generally has a circular shape, and a rear wall 105 is formed at the rear end 104 of the base portion 102. Even though FIG. 4*b* shows the whizzer cone 100 having the rear wall 105, the cone 100 may be designed without a rear wall, depending on the particular implementation of the whizzer cone 100 and the manner in which it is attached to a loudspeaker. Furthermore, as illustrated in FIG. 4*b*, the rear wall 105 has a flat, circular shape. However, the present embodiment is not limited to such a configuration, and the rear wall 105 may not lie within one plane and/or may have the shape of virtually any polygon. The particular design of the rear wall 105 will depend upon the specific implementation of the whizzer cone 100.

In the illustrative embodiment, the front end 103 of the base portion 102 resembles a sine wave that oscillates around the front edge of the whizzer cone 100. As a result, as shown in FIGS. 4*a* and 4*b*, the distance from the longitudinal axis of the base portion 102 to the outer edge of the front end 103 (i.e. the "radius" of the front end 103) oscillates between $a_{min}$ and $a_{max}$, and the height of the front end 103 from the rear end 104 oscillates between $h_{min}$ and $h_{max}$. Since the radius of the front end 103 changes and since the height of the front end 103 changes, discontinuities are created in the front end. In other words, as a result of the discontinuities, the distance from the neck of the whizzer cone 100 to the front end 103 of the whizzer cone 100 varies as one travels around the front end 103. By appropriately designing the size and shape of the discontinuities, the vibrational modes (e.g. the flexural modes) can be altered or suppressed in the base portion 102, the rear end 104, and/or the rear wall 105 of the whizzer cone 100. By altering the modes in a particular manner, the modes radiate more efficiently. As a result, the frequency response of the whizzer cone 100 is more uniform and does not contain any substantial "dips" or "peaks", and the whizzer cone accurately and precisely generates sound over the entire mid to high frequency range.

Figure 5:
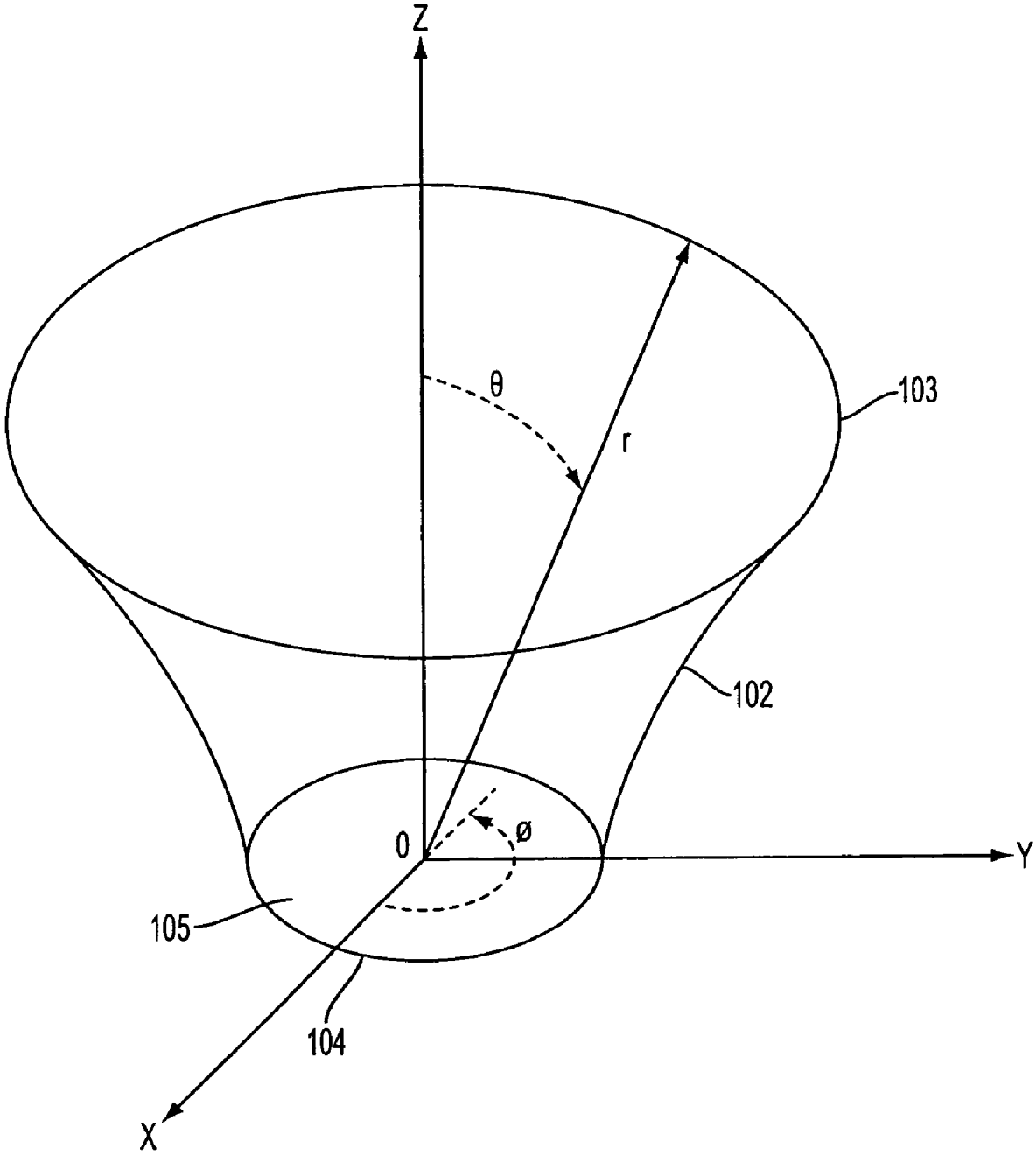
FIG. 5 is a graphical representation of a simplified version of the whizzer cone shown in FIGS. 4*a* and 4*b;*

The calculations of the various dimensions of the whizzer cone 100 in accordance with the above embodiment will be described below. Furthermore, in order to better explain the various dimensions of the whizzer cone 100, reference will be made to the graphical representation of a simplified version of the whizzer cone 100 shown in FIG. 5. In the version of the whizzer cone 100 shown in FIG. 5, the front end 103 of the base portion 102 is simply represented as a circle for the sake of clarity in describing the various dimensions of the whizzer cone 100.

As shown in the figure, the center of the rear wall 105 of the whizzer cone 100 corresponds to the origin of the three-dimensional graphical representation of the whizzer cone 100. Also, a vector r extends from the center of the rear wall 105 to the front end 103, and since discontinuities exist in the front end 103, the magnitude of the vector r changes as it is revolved around the z-axis. For example, when the vector r forms an angle $\phi_1$ with respect to the x-axis and intersects a point $P_1$ (FIG. 4*b*) on the front end 103, the "radius" of the front end 103 at the point $P_1$ equals $a_{min}$ and the height of the front end 103 at the point $P_1$ equals $h_{min}$. As a result, the magnitude of the vector r equals $r_{min}$ at the angle $\phi_1$. On the other hand, when the vector r forms an angle $\phi_2$ with respect to the x-axis and intersects a point $P_3$ (FIG. 4*b*) on the front end 103, the "radius" of the front end 103 at the point $P_3$ equals $a_{max}$ and the height of the front end 103 at the point $P_3$ equals $h_{max}$. In such case, the magnitude of the vector r equals $r_{max}$ at the angle $\phi_2$. Furthermore, when the vector r forms an angle $\phi_3$ with respect to the x-axis and intersects a point $P_2$ (FIG. 4*b*) on the front end 103, the "radius" of the front end 103 at the point $P_2$ equals $a_0$ and the height of the front end 103 at the point $P_2$ equals $h_0$. In such case, the magnitude of the vector r equals $r_0$ at the angle $\phi_3$.

In other words, as explained above, the following approximate relationships exist:

$$r_{max}=(a_{max}^2+h_{max}^2)^{1/2}$$

$$r_{min}=(a_{min}^2+h_{min}^2)^{1/2}$$

$$r_0=(a_0^2+h_0^2)^{1/2}$$

$$r_0=(r_{max}+r_{min})/2.$$

Figure 6:
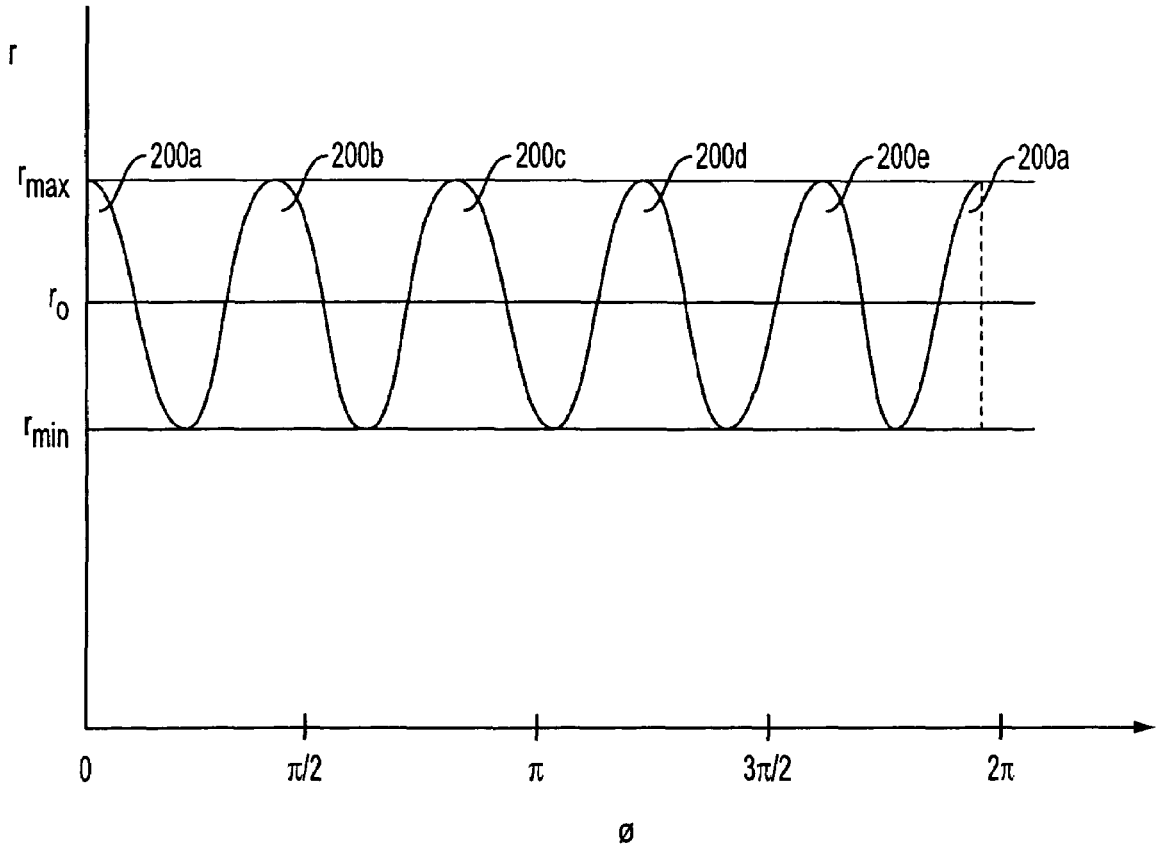
FIG. 6 is a graphical representation of a vector r of the whizzer cone shown in FIGS. 4*a* and 4*b*.

As noted above, the discontinuities in the front end 103 are represented by a sine wave. Accordingly, if the whizzer cone 100 is unraveled such that the front end 103 is laid flat in two dimensions, the vector r could be approximately represented by the sine wave shown in FIG. 6. As shown in FIG. 6, the discontinuities can be represented by five positive areas 200*a*–200*e* (i.e. lobes) of the sine wave. Accordingly, the shape of the front end 103 of the whizzer cone 100 can be approximated by the following equation $$r(\phi)=r_0+(A)(\sin[(m\phi)/(2\pi)]),$$

where A equals the amplitude of the sine wave (i.e. $A=r_{max}-r_0=r_0-r_{min}$) and m equals the number of discontinuities or lobes.

Upon reading the present application, one skilled in the art would clearly know how to determine the precise values of the amplitude A, the radii of the front end 103 (e.g. the radii $a_{min}$, $a_{max}$, and $a_0$), the heights of the front end 103 (e.g. the height $h_{min}$, $h_{max}$, and $h_0$), the radius $r_0$ and the vector $r(\phi)$. For example, the radii of the front end 103 may be experimentally determined for the particular application of the whizzer cone 100 and the materials used to create the whizzer cone 100. In addition, acoustical analysis of the radiation of the whizzer cone 100 via boundary element analysis techniques or finite element analysis techniques may be used to determine the optimum values of various parameters (e.g. the amplitude A) of the whizzer cone 100.

In one implementation, the radius $a_{min}$ of the whizzer cone 100 is determined in the following manner. First, the whizzer cone 1 shown in FIGS. 1*a* and 1*b* is obtained. As noted in the figures, the whizzer cone 1 contains the base portion 2 having the front end 3. Furthermore, the base portion 2 has a circular cross-section, and the front end 3 has a flat circular shape. Then, the height of the front end 3 is incrementally reduced by incrementally slicing through cross-sections of the base portion 2 (i.e. by slicing perpendicularly to the longitudinal axis of the base portion 2). After each incremental reduction of the front end 3, the frequency response of the whizzer cone 1 is tested, and the height of the front end 3 is reduced until the frequency response of the cone 1 is optimized. When the frequency response of the cone 1 is optimized, the radius of the front end 3 is selected as the radius $a_{min}$. In addition, in such implementation, the amplitude A of the sine wave is chosen to maximize the radiating area of the whizzer cone 100. Clearly, the determinations of the radius $a_{min}$ and the amplitude A are merely examples of how such dimensions can be determined. The manner in which such dimensions (as well as the other dimensions) of the whizzer cone 100 are determined will depend upon the application of the whizzer cone 100 and the materials used to make the whizzer cone 100.

In addition, as noted above, an odd number of discontinuities or lobes are provided in the front end 103 of the whizzer cone 100, and such lobes are evenly spaced around the circumference of the front end 103. Thus, as best shown in FIG. 4*b*, the radiating area of the portion of the whizzer cone 100 that is diametrically opposite to a particular lobe is substantially less than the radiating area of the particular lobe. Such a configuration substantially reduces the radiated field produced by circumferential waves that are generated when the circumference of the front end 103 of the whizzer cone 100 is an even multiple of the wavelength of the flexural wave. As a result, the amplitude of the flexural wave is not substantially affected, and the frequency response of the whizzer cone 100 is greatly enhanced.

Also, in the embodiment above, the edges of the discontinuities or lobes are tapered as one travels around the circumference of the front end 103. Such tapering of the lobes is gradual in comparison to the wavelength of the radial and circumferential flexural waves generated by the whizzer cone 100. The tapering provides a gradual edge transition for the flexural waves. Such a gradual edge transition suppresses the resonance of the flexural waves in both the radial and circumferential directions of the whizzer cone 100 and reduces the quality factor Q of the flexural resonances. Hence, the operating frequency bandwidth of the whizzer cone 100 is increased. Accordingly, the uniformity of the frequency response of the whizzer cone 100 is dramatically improved.

Although the embodiment above contains discontinuities that correspond to a sine wave travelling around the circumference of the front end 103 of the whizzer cone 100, the present invention is clearly not limited to such a configuration. For example, such discontinuities could be represented by a triangular wave, a square wave, or any other type of wave. One of ordinary skill in the art would clearly know how to appropriately determine the dimensions of such waves for a particular implementation upon reading the disclosure of the present application.

In addition, the discontinuities contained in the front end 103 of the whizzer cone 100 could be represented by other configurations besides a cyclical wave and do not need to be evenly and uniformly spaced around the circumference of the front end 103. In fact, the discontinuities may take the form of any type of polygon or other configuration. Moreover, all of the discontinuities do not necessarily need to have the same size or the same shape. Again, one of ordinary skill in the art would clearly know how to appropriately determine the dimensions and shapes of the discontinuities for a particular implementation upon reading the disclosure of the present application.

Furthermore, although the embodiment disclosed above preferably contains an odd number of discontinuities provided at the front end 103 of the whizzer cone 100, the front end 103 may contain an even number of discontinuities and still provide satisfactory results. In fact, in some applications, an even number of discontinuities may be preferred depending on the shapes and sizes of the discontinuities and the particular application of the whizzer cone 100.

Also, in the embodiment described above, the base portion 102 has a circular cross-section. However, the present invention is clearly not limited to such a configuration. For example, the cross-section of the base portion 102 may be square-shaped, triangular-shaped, or shaped like any other type of polygon.

Furthermore, in the embodiment discussed above, discontinuities are contained only in the front end 103 of the whizzer cone 100. However, the present invention is not limited to such a configuration. For instance, discontinuities could also be contained in the rear end 104 instead of the front end 103. Alternatively, discontinuities could be contained in both the front end 103 and the rear end 104. In addition, the discontinuities in the front end 103 and the discontinuities in the rear end 104 may have the same shape and/or size or may have different shapes and/or sizes.

Figure 7:
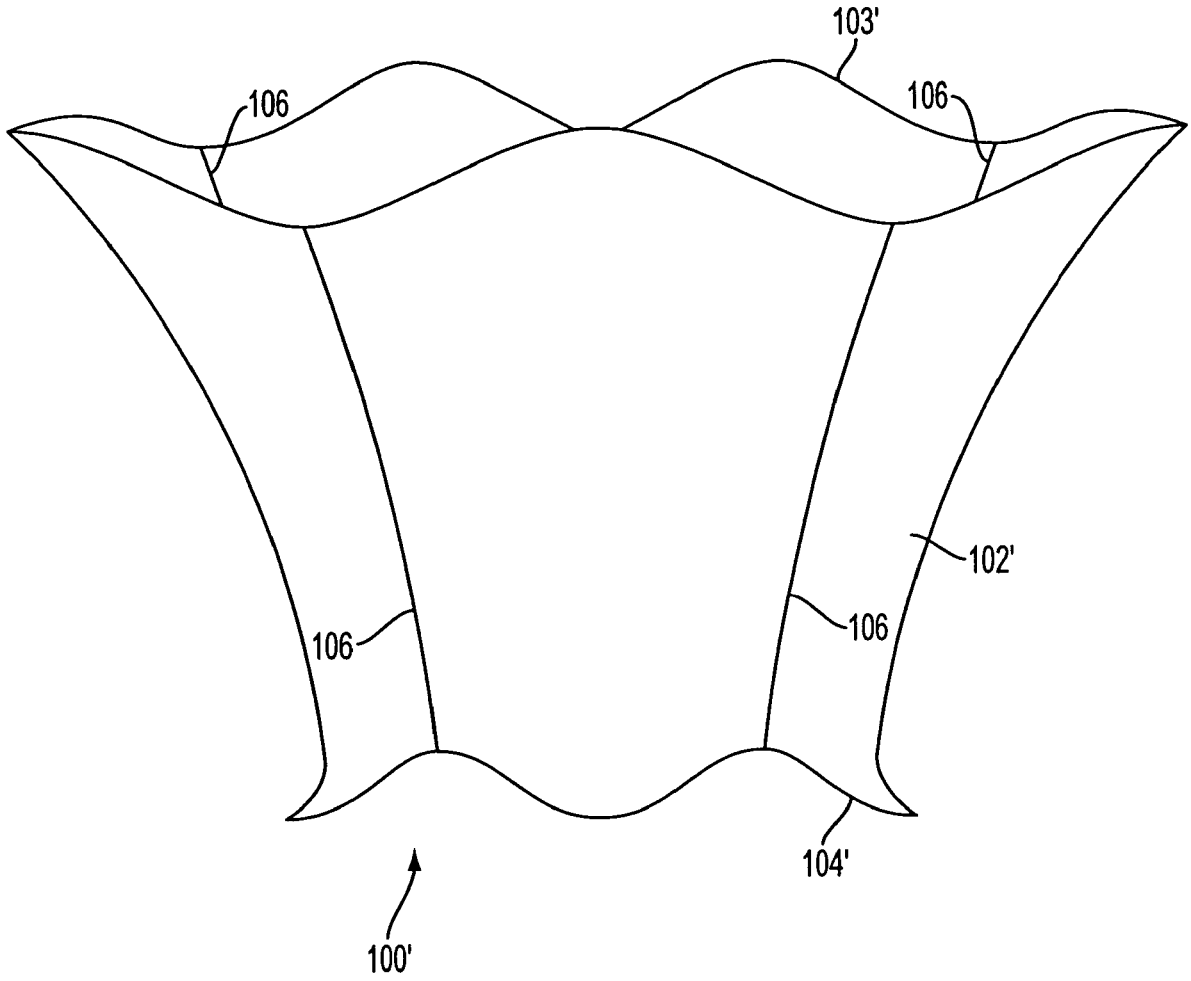
FIG. 7 is a side view of a whizzer cone in accordance with another illustrative embodiment of the present invention.

Furthermore, in order to enhance the alteration of the various vibrational mode resonances, holes or slits may be provided in the side of the base portion 102. Alternatively or additionally, ribs may be provided in the interior or on the exterior of the base portion 102. Such holes, slits, and/or ribs may be used instead of or in addition to the discontinuities in the front end 103 and/or rear end 104. In addition, by forming particular discontinuities in both the front end 103 and the rear end 104, ribs may be easily formed in the base portion 102. FIG. 7 illustrates an example of such a whizzer cone 100' in which the discontinuities formed in the front end 103' and the rear end 104' enable ribs 106 to be easily created in the base portion 102'. However, such ribs 106 are only one specific example of the many types of ribs that may be formed in or on the base portion 102.

In addition, although the above embodiment is directed to a whizzer cone 100, the present invention is not limited to such an implementation and can be incorporated into many different types of speaker cones. For example, the present invention may be used in a traditional loudspeaker cone in which the front edge of the cone is physically constrained or connected to a speaker chassis.

In the embodiments and examples discussed above, the whizzer cone 100 or 100' has a configuration that substantially reduces and/or eliminates the effects of the vibrational mode resonances. As a result, the frequency response of the whizzer cone 100 or 100' is smoother, and the frequency range of the frequency response is substantially extended. As a result, the whizzer cone 100 or 100' reproduces sound from input audio signals more precisely and accurately.

The previous description of the preferred embodiments is provided to enable a person skilled in the art to make and use the present invention. Moreover, various modifications to these embodiments will be readily apparent to those skilled in the art, and the generic principles and specific examples defined herein may be applied to other embodiments without the use of inventive faculty. Therefore, the present invention is not intended to be limited to the embodiments described herein but is to be accorded the widest scope as defined by the limitations of the claims and equivalents thereof.

What is claimed is:

1. A speaker cone comprising a base portion having a front end and a rear end, wherein the front end contains a plurality of lobes such that a distance from a reference point on a longitudinal axis of the base portion to the front end vanes along the edge of the front end, wherein a flexural wave is radiated from the base portion past the front end when the base portion vibrates, wherein the lobe substantially reduces an occurrence of at least one geometric mode resonance created by the flexural wave, wherein at least one lobe comprises a first lobe, and wherein the first lobe comprises a radiating area that is substantially greater than a radiating area of a portion of the front end diametrically opposed to the first lobe.

2. The speaker cone as claimed in claim 1, wherein at least one lobe comprises the first lobe and a second lobe is disposed adjacent to the first lobe on the front end, and wherein a radius of the front end gradually changes when traveling along the front end from the first lobe to the second lobe.

3. The speaker cone as claimed in claim 1, wherein at least one lobe comprises the first lobe and a second lobe disposed adjacent to the first lobe on the front end, and wherein a height of the front end gradually changes when traveling along the front end from the first lobe to the second lobe.

4. The speaker cone as claimed in claim 3, wherein a radius of the front end gradually changes when traveling along the front end from the first lobe to the second lobe.

5. A speaker cone, comprising:

a base portion having a front end and a rear end, wherein the front end contains a plurality of lobes that form a cyclical wave viewed perpendicularly to the surface of the lobe in the front end, and wherein a length of the radius from a central axis varies along the edge of each of the plurality of lobes from the tip of the lobe, wherein a flexural wave is radiated from the base portion past the front end when the base portion vibrates, wherein the lobe substantially reduces an occurrence of at least one geometric mode resonance created by the flexural wave, and wherein at least one lobe comprises a first lobe, and wherein the first lobe comprises a radiating area that is substantially greater than a radiating area of a portion of the front end diametrically opposed to the first lobe.

6. The speaker cone as claimed in claim 5, wherein at least one lobe comprises the first lobe and a second lobe is disposed adjacent to the first lobe on the front end, and wherein a radius of the front end gradually changes when traveling along the front end from the first lobe to the second lobe.

7. The speaker cone as claimed in claim 5, wherein at least one lobe comprises the first lobe and a second lobe disposed adjacent to the first lobe on the front end, and wherein a height of the front end gradually changes when traveling along the front end from the first lobe to the second lobe.

8. The speaker cone as claimed in claim 7, wherein a radius of the front end gradually changes when traveling along the front end from the first lobe to the second lobe.

9. A speaker cone comprising a base portion having a front end and a rear end, wherein the front end contains a plurality of lobes such that a distance from a reference point on a longitudinal axis of the base portion to the front end varies along the edge of the front end In a smooth, continuous manner, wherein at least one lobe of the plurality of lobes comprises a first lobe, wherein the first lobe comprises a radiating area that Is substantially greater than a radiating area of a portion of the front end diametrically opposite to the first lobe.

10. The speaker cone as claimed in claim 9, wherein the front end comprises an odd number of lobes.

11. The speaker cone as claimed in claim 9, wherein the front end comprises five lobes.

12. The speaker cone as claimed in claim 9, wherein a latitudinal cross section of the base portion is circular.

13. The speaker cone as claimed in claim 9, wherein a flexural wave is radiated from the base portion past the front end when the base portion vibrates, and wherein the lobe substantially reduces an occurrence of at least one geometric mode resonance created by the flexural wave.

14. The speaker cone as claimed in claim 13, wherein at least one geometric mode resonance comprises an azimuthal mode resonance.

15. The speaker cone as claimed in claim 13, wherein at least one geometric mode resonance comprises a radial mode resonance.

16. An speaker cone comprising a base portion having a front end and a rear end, wherein the front end contains a plurality of lobes that form a cyclical wave viewed perpendicularly to the surface of the lobe in the front end, and wherein a length of the radius from a central axis varies along the edge of each of the plurality of lobes from the tip of the lobe in a smooth, continuous manner, wherein said plurality of lobes are diametrically asymmetric.

17. The speaker cone recited in claim 16, wherein the front end comprises an odd number of lobes.

18. The speaker cone as claimed in claim 16, wherein the front end comprises five lobes.

19. The speaker cone as claimed in claim 16, wherein a latitudinal cross section of the base portion is circular.

20. The speaker cone as claimed in claim 16, wherein a flexural wave is radiated from the base portion past the front end when the base portion vibrates, and wherein the lobe substantially reduces an occurrence of at least one geometric mode resonance created by the flexural wave.

21. The speaker cone as claimed in claim 20, wherein at least one geometric mode resonance comprises an azimuthal mode resonance.

22. The speaker cone as claimed in claim 20, wherein at least one geometric mode resonance comprises a radial mode resonance.

* * * * *